US007350317B2

(12) United States Patent
Matsui et al.

(10) Patent No.: US 7,350,317 B2
(45) Date of Patent: Apr. 1, 2008

(54) ELECTROSTATIC ATOMIZING HAIRDRYER AND ELECTROSTATIC ATOMIZER

(75) Inventors: Yasunori Matsui, Hikone (JP); Osamu Imahori, Hikone (JP); Shosuke Akisada, Hikone (JP); Fumio Mihara, Hikone (JP); Akihide Sugawa, Hikone (JP); Toshihisa Hirai, Hikone (JP); Takashi Nakagawa, Hikone (JP); Kozo Kawai, Neyagawa (JP); Naofumi Kodama, Nagahama (JP); Tomohiro Yamaguchi, Yasu (JP); Kiyoshi Takashima, Hikone (JP); Kousuke Katayama, Kadoma (JP); Junichi Watanabe, Kadoma (JP)

(73) Assignee: Matsushita Electric Works, Ltd., Osaka (JP)

( * ) Notice: Subject to any disclaimer, the term of this patent is extended or adjusted under 35 U.S.C. 154(b) by 35 days.

(21) Appl. No.: 11/234,173

(22) Filed: Sep. 26, 2005

(65) Prior Publication Data

US 2006/0064892 A1 Mar. 30, 2006

(30) Foreign Application Priority Data

Sep. 27, 2004 (JP) ..... 2004-280498
Jan. 28, 2005 (JP) ..... 2005-022167

(51) Int. Cl.
*A45D 20/12* (2006.01)

(52) U.S. Cl. ..... 34/96

(58) Field of Classification Search ..... 34/96, 34/97, 98, 99, 100; 392/380, 384; 132/212, 132/222

See application file for complete search history.

(56) References Cited

U.S. PATENT DOCUMENTS 3,794,243 A * 2/1974 Tamny et al. ..... 239/3
4,256,127 A 3/1981 Tsujimoto et al.

(Continued)

FOREIGN PATENT DOCUMENTS

EP 0523963 1/1993

(Continued)

OTHER PUBLICATIONS

English Language Abstract of JP 2004-085185.

(Continued)

*Primary Examiner*—S. Gravini
(74) *Attorney, Agent, or Firm*—Greenblum & Bernstein, P.L.C.

(57) ABSTRACT

In an electrostatic atomizing hairdryer, electrostatically atomized mist generated in an electrostatic atomizing unit is effectively scattered into airflow emitted from a main body of the hairdryer so that the mist can be sprayed to hair uniformly and a time necessary for treatment of hair can be shortened. A tank constituting the electrostatic atomizing unit is detachably provided on a portion in the vicinity of an outer periphery of the main body, and an electrode unit for generating the mist is provided in a path of airflow sucked in an inside of the main body so as to be insulated from heat of a heating unit by an adiabator. A mist emitting opening from which the mist is emitted is disposed on a plane substantially the same as and at substantially the center of an air exit opening of the main body. Thereby, the mist emitted from the mist emitting opening is effectively scattered into the airflow emitted from the air exit opening.

13 Claims, 17 Drawing Sheets

U.S. PATENT DOCUMENTS

| | | | | |
|---|---|---|---|---|
| 4,555,232 | A * | 11/1985 | Raccah et al. | 432/222 |
| 4,635,382 | A * | 1/1987 | Bourdeau | 34/97 |
| 6,725,562 | B2 * | 4/2004 | Nakagawa et al. | 34/96 |
| 6,763,606 | B2 * | 7/2004 | Saida | 34/97 |
| 6,923,794 | B2 * | 8/2005 | Ohmura | 604/291 |
| 2003/0033726 | A1 * | 2/2003 | Saida | 34/96 |
| 2003/0055469 | A1 | 3/2003 | Ohmura | |

FOREIGN PATENT DOCUMENTS

| | | |
|---|---|---|
| EP | 1295625 | 3/2003 |
| JP | 4-220204 | 8/1992 |
| JP | 2002-151146 | 5/2002 |
| JP | 2004-085185 | 3/2004 |

OTHER PUBLICATIONS

English Language Abstract of JP 4-220204.
English Language Abstract of JP 2002-151146.

* cited by examiner (a)

(b)

ELECTROSTATIC ATOMIZING HAIRDRYER AND ELECTROSTATIC ATOMIZER

BACKGROUND OF THE INVENTION

1. Field of the Invention

The present invention relates to a hairdryer used for drying or setting hair by blowing warm blast and cold blast, and especially relates to an electrostatic atomizing hairdryer which can perform treatment of hair by emitting jet of mist electrostatically atomized, and relates to an electrostatic atomizer for generating mist by electrostatically atomizing a liquid.

2. Description of the Related Art

An electrostatic atomization technique to let water of form of minute mist (hereinafter, it is called "mist") scatter by applying high voltage on feed water field member as a capillary tube is conventionally known. For example, in Japanese Laid-Open Patent Publication No. 2002-151146, this electrostatic atomization technique is applied to a hairdryer to obtain advantageous effects for improving moisture-holding characteristic of hair and giving hair gathered up feeling and shine by spraying mist to hair.

In the conventional electrostatic atomizing hairdryer described in Japanese Laid-Open Patent Publication No. 2002-151146, the electrostatic atomizer, however, is provided on outside of a main body of the hairdryer, so that the mist cannot be scattered effectively into airflow emitted from the main body of the hairdryer, and it is difficult to spray the mist to hair evenly in a short time. Therefore, a time necessary for treatment of hair becomes longer, and overdrying of hair may occur partially.

On the other hand, in an electrostatic atomizer for generating electrostatically atomized mist described in, for example, Japanese Laid-Open Patent Publication No. 2004-85185, high voltage is applied between an atomizing electrode and an opposing electrode so as to generate Rayleigh disrupture in water at front end of the atomizing electrode. The water repeats the disrupture with receiving large energy due to high voltage, so that mist of nanometer size with activated species of high reactivity is generated. Room air or incrustation on an indoor wall surface can be deodorized by such mist.

In order to scatter the mist effectively, an airflow path comprising a blower is provided in the electrostatic atomizer. The atomizing electrode and the opposing electrode are arranged in the airflow path, so that the mist is scattered with the airflow. In such a case, it is necessary to contain the atomizing electrode and the opposing electrode in a housing for electrostatic atomization to prevent that the liquid at the front end of the atomizing electrode is exposed to airflow in the airflow path directly and is evaporated. In addition, the electrostatically atomized mist generated at the front end of the atomizing electrode is moved toward the opposing electrode by electrostatic force, so that a mist emitting opening from which the mist is emitted to outside of the housing for electrostatic atomization is provided in the vicinity of the opposing electrode.

The mist, however, cannot be emitted efficiently from the mist emitting opening of the housing for electrostatic atomization even though the housing for electrostatic atomization is merely provided in the airflow path. Thus, the mist may stay in the housing for electrostatic atomization, or be adsorbed to the opposing electrode by electrostatic force. Furthermore, when a quantity of liquid which is to be electrostatically atomized is increased to increase a quantity of scattered mist, not only consumption of the liquid and electric power increase, but also a quantity of ozone which is a vice-product increases. Still furthermore, when a nozzle is provided for scattering the mist, it causes the upsizing and the increase of cost of the apparatus.

SUMMARY OF THE INVENTION

The present invention is aimed to provide an electrostatic atomizing hairdryer which can scatter electrostatically atomized mist generated by an electrostatic atomizer into airflow emitted from a main body of the hairdryer efficiently for enabling to spray the mist to hair evenly and to shorten a time necessary for treatment of hair. Furthermore, the present invention is aimed to provide an electrostatic atomizer which has a simple configuration and can emit the electrostatically atomized mist from a mist emitting opening of a housing for electrostatic atomization contain an atomizing electrode and an opposing electrode therein.

An electrostatic atomizing hairdryer in accordance with an aspect of the present invention comprises: a main body having an air suction opening and an air exit opening; a blower provided in inside of the main body, sucking air from the air suction opening into the inside of the main body, generating airflow in the inside of the main body and emitting the airflow from the air exit opening; a heater for heating a part of or all of the airflow generated by blower; and an electrostatic atomizing unit having at least a tank storing liquid, a mist generator generating mist by electrostatically atomizing the liquid supplied from the tank, and a mist emitting opening from which the mist is emitted. The mist emitting opening is provided in a path of the airflow generated by the blower, so that the mist emitted from the mist emitting opening is scattered into the airflow emitted from the air exit opening.

According to such a configuration, since the mist emitting opening is provided in the path of the airflow generated in the inside of the main body of the hairdryer, the mist emitted from the mist emitting opening can be scattered into the airflow emitted from the air exit opening efficiently in comparison with the conventional electrostatic atomizing hairdryer that the electrostatic atomizing unit is provided outside of the main body of the hairdryer. Thus, it is possible to splay the mist to hair evenly in a short time, to shorten a time necessary for treatment of hair, and to prevent occurrence of partial overdrying of hair. Consequently, the electrostatic atomizing hairdryer, which can give treatment advantageous effect to surface of a hair and to give shine and moisture to hair efficiently in a short time, can be provided.

An electrostatic atomizer in accordance with another aspect of the present invention comprises: a housing for airflow path forming an airflow path therein; a blower provided in the housing for airflow path and generating airflow; a housing for electrostatic atomization provided at downstream side from the blower in the housing for airflow path; an atomizing electrode provided in the housing for electrostatic atomization and having a needle or stick shape for generating mist by electrostatically atomizing liquid at a front end thereof; a liquid feeder for feeding liquid to the front end of the atomizing electrode; an opposing electrode provided in the housing for electrostatic atomization and disposed for facing the front end of the atomizing electrode; a voltage applying circuit for applying a voltage between the atomizing electrode and the opposing electrode; and a mist emitting opening formed on the housing for electrostatic atomization in a vicinity of the opposing electrode, through which mist formed at the front end of the atomizing electrode and moved toward the opposing electrode by electrostatic force is emitted to outside of the housing for electrostatic atomization. The atomizing electrode is protruded toward downstream side from an inner wall surface at upstream side of the airflow path in the housing for electrostatic atomization, and the opposing electrode is disposed at downstream side than the atomizing electrode. The introduction openings for introducing airflow into the inside of the housing for electrostatic atomization are formed in a portion on a side wall of the housing for electrostatic atomization, the portion is located between a portion substantially facing an inner end wall from which the atomizing electrode is protruded and a portion substantially facing the front end of the atomizing electrode in a flowing direction of airflow in the airflow path. A tapered portion is formed on the inner end wall so that a diameter thereof becomes smaller as for the downstream side.

According to such a configuration, since the introduction openings are provided on the housing for electrostatic atomization, the airflow is introduced into and further flows in the inside of the housing for electrostatic atomization. Thus, the mist generated at the front end of the atomizing electrode is smoothly emitted with the airflow from the mist emitting opening without being sucked to the opposing electrode. Consequently, a quantity of mist scattered from the electrostatic atomizer can be increased. Especially, since the introduction openings are formed in the portion between the inner end wall and the portion substantially facing the front end of the atomizing electrode in the flowing direction of airflow in the airflow path, it is possible to prevent the occurrence of turbulent flow in the vicinity of the front end of the atomizing electrode. Consequently, it is possible to reduce pressure loss while the airflow passes through the housing for electrostatic atomization. Furthermore, since the tapered portion is formed on the inner end wall of the housing for electrostatic atomization in a manner so that the diameter thereof becomes smaller as for the downstream side, it is possible to change the direction of the airflow introduced into the inside of the housing for electrostatic atomization from the introduction openings to a direction parallel to the axis of the housing for electrostatic atomization smoothly. Consequently, it is possible to prevent the occurrence of turbulent flow in the vicinity of a base end of the protrusion of the atomizing electrode.

DETAILED DESCRIPTION OF THE EMBODIMENTS

First Embodiment

Figure 1:
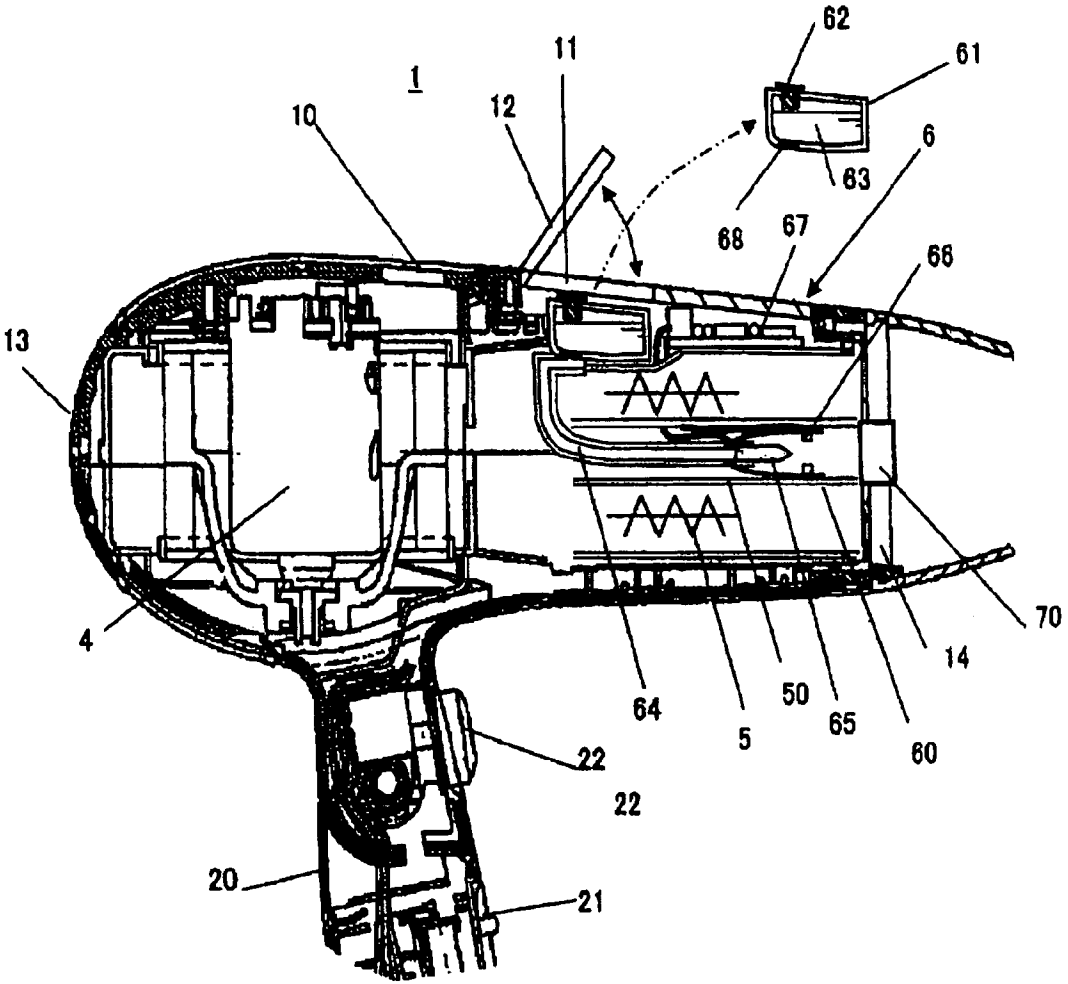
FIG. 1 is a sectional view showing a constitutional example of an electrostatic atomizing hairdryer in accordance with a first embodiment of the present invention.

An electrostatic atomizing hairdryer 1 in accordance with a first embodiment of the present invention is described with reference to the figures. FIG. 1 is a sectional view showing a configuration of the electrostatic atomizing hairdryer 1 in accordance with the first embodiment.

The electrostatic atomizing hairdryer 1 (hereinafter, it is called merely "hairdryer 1") is comprised of a main body 10, a grip 20 that is established to make predetermined angle for the main body 10, and so on. A blower 4 configured by a motor, a fan, and so on is provided in an inside of the main body 10 and in the vicinity of a junction between the main body 10 and the grip 20. An air suction opening 13 is formed on a rear end of the main body 10 (left end in the figure), and a grating is provided on the air suction opening 13 so that no finger or no extraneous material cannot be inserted for safety. A heating unit 5 comprised of a heater, and so on and an electrostatic atomizing unit 6 are provided in the inside of the main body 10 and in a downstream side of airflow with respect to the blower 4. A grating is further provided on an air exit opening 14 so that no finger or no extraneous material cannot be inserted for safety. By providing a protection member for preventing entering of extraneous material such as the grating on each of the air suction opening 13 and the air exit opening 14, it is possible to prevent electric shock or kindling due to insertion of extraneous material.

In addition, a slide switch 21 and a push switch 22 are provided on the grip 20. The slide switch 21 is used for switching on and off of blast, switching of hot blast and cold blast, and switching of strong and weak of hot blast. The push switch 22 is used for switching on and off of spray of mist. When the slide switch 21 is switched on, the fan of the blower is rotated so that air is sucked into the inside of the main body 10 from the air suction opening 13 by the blower 4. When the hot blast is chosen, airflow generated in the inside of the main body 10 by the blower 4 is flows toward the heating unit 5, so that a part of or all of the airflow is heated by the heater while it passes through the heating unit, and emitted from the air exit opening 14 as hot blast. Furthermore, when the spray of the mist is chosen, the mist is further emitted from the electrostatic atomizing unit 6 by switching on the push switch 22, so that the mist is scattered into the airflow emitted from the air exit opening 14 efficiently and sprayed to hair of a user.

The electrostatic atomizing unit 6 is comprised of an electrode unit (mist generator) 60 having an atomizing electrode (center electrode) 65 for generating electrostatically atomized mist and an opposing electrode 66, a tank 61 for storing liquid 63 such as water, a liquid feed pipe 64 for feeding the liquid 63 from the tank 61 to the electrode unit 60, and a high voltage generating circuit 67 for applying a predetermined voltage between the atomizing electrode 65 and the opposing electrode 66.

The electrode unit 60 is thermally insulated from the heating unit 5 by an adiabator (thermal insulation member) 50, and disposed to penetrate substantially the center of the heating unit 5. In this way, it is possible to prevent that the mist generated in the electrode unit 60 is evaporated when a temperature rise of electrode unit 60 due to heat from the heating unit 5 is restrained by the adiabator 50. A mist emitting opening 70 is provided at a position substantially on the same plane as the air exit opening 14, which is perpendicular to a direction of the airflow generated by the blower 4. The mist emitting opening 70 is at substantially the center of the air exit opening 14 in this embodiment. The mist emitting opening 70, however, is not provided on substantially the same plane as the air exit opening 14, and it is possible to be disposed at upstream side or downstream side than the air exit opening 14.

The tank 61 is detachable from the main body 10. A tank mounting unit 11 and a cover 12 thereof are provided on the main body 10 so as to mount the tank 61. The liquid feed pipe 64 is provided for connecting between a bottom of the tank mounting unit 11 and the atomizing electrode 65. Furthermore, a liquid inlet 62 through which the liquid 63 is filled into the tank 61 and a liquid outlet 68 through which the liquid 63 in the tank 61 is fed into the liquid feed pipe 64 are provided on the tank 61.

A protection member for preventing entering of extraneous material such as the grating is further provided on the mist emitting opening 70 so as not to enter a finger or an extraneous material into the electrode unit 60. However, when the protection member for preventing entering of extraneous material is provided on the mist emitting opening 70, the protection member for preventing entering of extraneous material may be electrostatically charged so that convergence of electric field to the opposing electrode 66 to which a high voltage is applied decreases. Consequently, particle size of the mist may grow big, and number of the mist generated by the electrode unit 60 may decrease. Therefore, it becomes difficult to obtain the advantageous effects for improving moisture-holding characteristic of hair and giving hair gathered up feeling and shine by spraying mist to hair. Therefore, antistatic provision is put to the protection member for preventing entering of extraneous material provided on the mist emitting opening 70. Specifically, antistatic material such as a resin of silicon system, organic boron system, or polymer macromolecule system is applied on a surface of the grating provided on the mist emitting opening 70. Alternatively, it is possible to ground the grating itself. Alternatively, a voltage much lower than a voltage applied to the atomizing electrode 65 may be applied to the opposing electrode 66.

On the other hand, it is possible to provide a portion where an opening gap is made narrower about 3 to 7 mm extent in a part of or entire of the mist emitting opening 70 so as not to enter a finger or protection member for preventing entering of extraneous material into the electrode unit 60 from the mist emitting opening 70 without providing the protection member for preventing entering of extraneous material such as grating on the mist emitting opening 70. In addition, it is desirable that the mist emitting opening 70 is protruded toward downstream side from the air exit opening 14 for scattering the mist into the blast from the air exit opening 14 efficiently. The mist emitting opening 70, however, may be provided on the same plane as or at upstream side from the air exit opening 14.

It is desirable to provide the tank 61 of the electrostatic atomizing unit 6 at a position that is hard to be affected by heat of the heating unit 5 for preventing expansion of the liquid 63 due to heat and leakage of the liquid 63 thereby. As illustrated in FIG. 1, the tank 61 is disposed at upstream side from the heating unit 5 in the first embodiment. The present invention, however, is not limited to such a configuration, and the tank 61 may be disposed at a position insulated by an adiabator even though it is not at upstream side from the heating unit 5 in an airflow path. Alternatively, the tank 61 may be formed of a thermal insulation material. In these cases, it is possible to provide he tank 61 in a circumference of the heating unit 5, inside of the heating unit 5 or in the downstream side from the heating unit 5 in the airflow path.

In order to make the suppliance of the liquid 63 into the tank 61 easy, the tank mounting unit 11 is provided at an upper portion of the main body 10 of the hairdryer 1 so that the tank 61 is detachable mounted, as illustrated in FIG. 1. When the tank 61 is detachable, the position of the tank mounting unit 11 is not limited to the position illustrated, and it is possible to be provided at a lower portion or a side portion of the main body 10. The tank 61, however, is not necessarily detachable, and it is possible to fix the tank 61 on the main body 10. In such a case, it is preferable to provide the liquid inlet 62 of the tank 61 at a portion facing outside such as an upper, a lower or a side portion of the main body 10 so as to make the suppliance of the liquid 63 into the tank 61 easily. Furthermore, the tank 61 may be provided at a position not facing outside of the main body 10. In such a case, it is necessary to provide a liquid afflux path connecting between a liquid inlet provided on an outer periphery portion of the main body 10 and the liquid inlet 62 of the tank 61. Still furthermore, a cap or a check valve may be provided on the tank 61 or in a portion of the liquid afflux path for preventing leakage of the liquid 63 with no relation to the position of the tank 61. Still furthermore, a felt member may be used together in the liquid feed pipe 64 for feeding the liquid 63 to the electrode unit 60 and/or a liquid afflux path connecting to the tank 61 and the outer periphery portion of the main body 10.

Since the hairdryer 1 is used at various angle, a lock mechanism may be provided on the cover 12 of the tank mounting unit 11 for preventing dismount of the tank 61. Alternatively, an interlock mechanism may be provided to fix the tank 61 on the tank mounting unit 11. Furthermore, a press fit unit configured of a packing such as a rubber may be provided on the tank mounting unit 11 and the tank 61 may be fixed by press fitted to the press fit unit. The same goes for the case that the cover 12 is omitted and the tank 61 is directly provided on the outer periphery portion of the main body 10 detachably.

Still furthermore, it is possible to omit the tank 61, and to use the liquid afflux path connecting the outer periphery portion of the main body 10 and the electrode unit 60 as a substitution of the tank 61. When porous subject such as ceramics, felt or metal mesh structure is used for a material of the atomizing electrode 65, the atomizing electrode 65 can serve as a part of a liquid accumulator for accumulating the liquid 63.

For applying a voltage to the atomizing electrode 65 of the electrode unit 60 from the high voltage generating circuit 67, it is possible to use not only a method for applying the voltage directly to the atomizing electrode 65 via a wire, and so on, but also a method for applying the voltage to the atomizing electrode 65 via the liquid 63 in the tank 61 and the liquid in the liquid feed pipe 64. A voltage that is generated by the high voltage generating circuit 67 and much lower than a voltage applied to the atomizing electrode 65 is applied to the opposing electrode 66. It, however, is possible to apply a voltage at lower voltage side of the high voltage generating circuit 67 bay be applied to the opposing electrode 66. In addition, a voltage of commercial power inputted to the hairdryer 1 may be applied to the opposing electrode 66 directly, or after voltage transformation.

Second Embodiment

Figure 2:
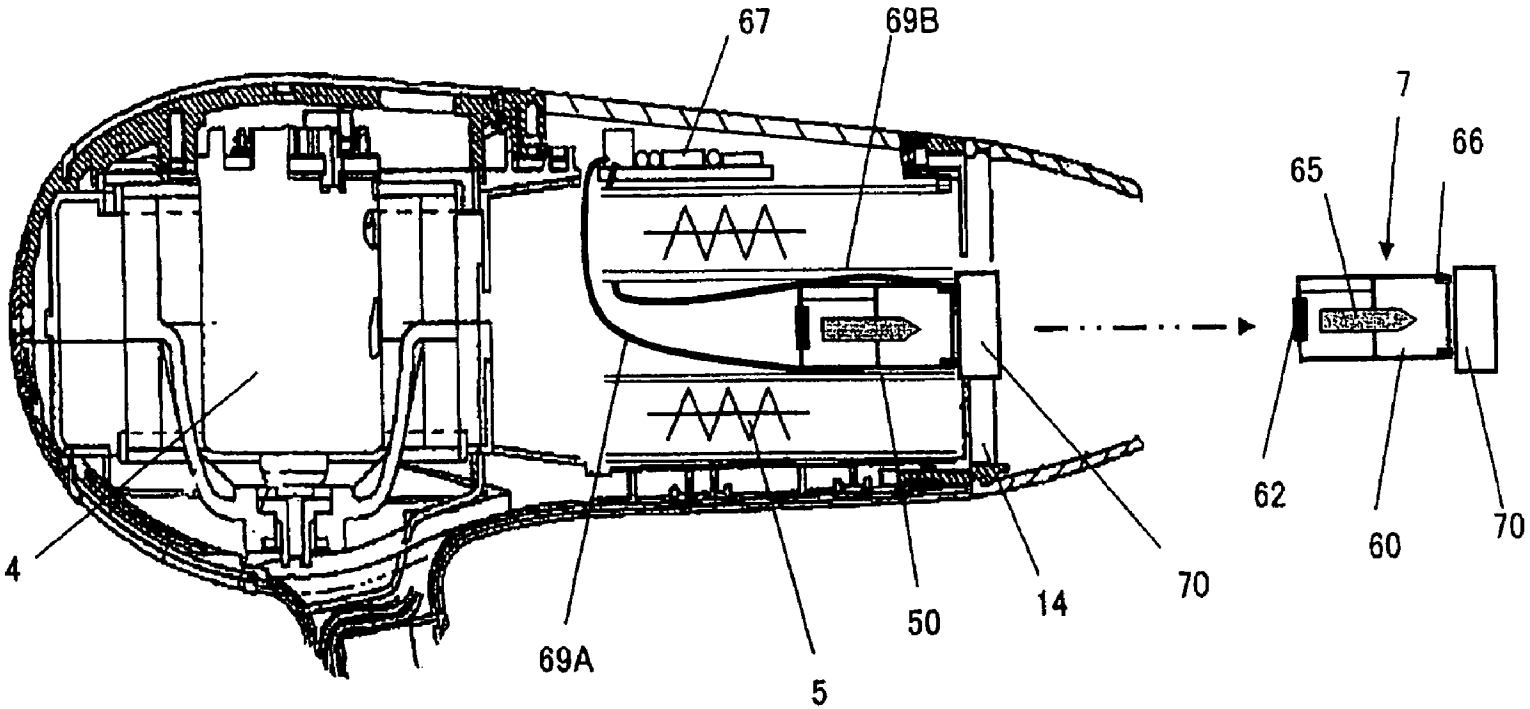
FIG. 2 is a sectional view showing a constitutional example of an electrostatic atomizing hairdryer in accordance with a second embodiment of the present invention.

Subsequently, an electrostatic atomizing hairdryer 1 in accordance with a second embodiment of the present invention is described. FIG. 2 is a sectional view showing a configuration of the hairdryer 1 in accordance with the second embodiment. In the second embodiment, the electrode unit 60 and the tank 61 are unified, and it is detachable from the main body 10.

As shown in FIG. 2, the electrode unit 60 and the tank 61 are unified for constituting a cartridge 7 which is detachable from the main body 10. Furthermore, a member with the mist emitting opening 70 (hereinafter, abbreviated as mist emitting opening member 70), to which antistatic treatment is given, is attached to the cartridge 7 similar to the above first embodiment. Since the atomizing electrode 65 is provided for penetrating a partition wall between the electrode unit 60 and the tank 61, it is possible to omit the liquid feed pipe 64 and the liquid afflux path which are needed in the first embodiment. On the other hand, conductors 69A and 69B are provided for applying a voltage to the atomizing electrode 65 from the high voltage generating circuit 67 and to apply a predetermined voltage to the opposing electrode 66. As for the conductors 69A and 69B, a terminal of contact type such as flat spring electrode or a terminal of spigot type can be used. Furthermore, the high voltage generating circuit 67 may be detachable, too. In such a case, the terminal of contact type or terminal of spigot type can be used for an input terminal of primary coil side of the high voltage generating circuit 67.

In this way, the electrode unit 60, the tank 61 and the mist emitting opening member 70 are unified for the cartridge 7, and the cartridge 7 is detachable from the main body 10 of the hairdryer 1, so that the liquid 63 can be filled up easily into the tank 61. Furthermore, dust adhered on the mist emitting opening member 70 can easily be removed. Still furthermore, although calcium may separate out on the atomizing electrode 65 of the electrode unit 60 while the employment in long-term, the separated calcium can be removed relatively easier.

Figure 3:
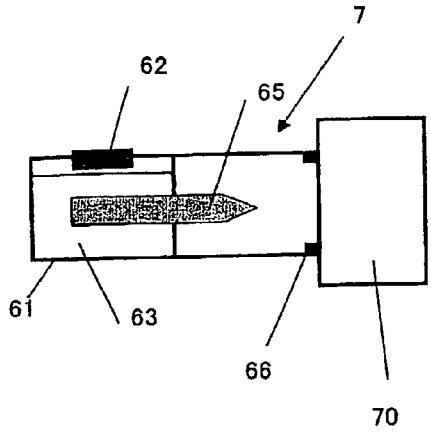
FIG. 3 is a sectional view showing another constitutional example of a cartridge in the second embodiment.

Another constitutional example of the cartridge 7 is shown in FIG. 3. In the constitutional example shown in FIG. 2, the liquid inlet 62 is provided on a rear end face of the tank 61, but in the constitutional example shown in FIG. 3, the liquid inlet 62 is provided on a side face of the tank 61. Cross-sectional shape of the cartridge 7 in a direction perpendicular to a paper sheet of the figure is not limited in particular, it, however, is preferable to be substantially circular or substantially rectangular in view of ease of manufacturing. The constitutional example shown in FIG. 2 is suitable in the case that the cross-sectional shape of the cartridge 7 is substantially circular, and constitutional example shown in FIG. 3 is suitable in the case that the cross-sectional shape of the cartridge 7 is substantially rectangular.

Figure 4:
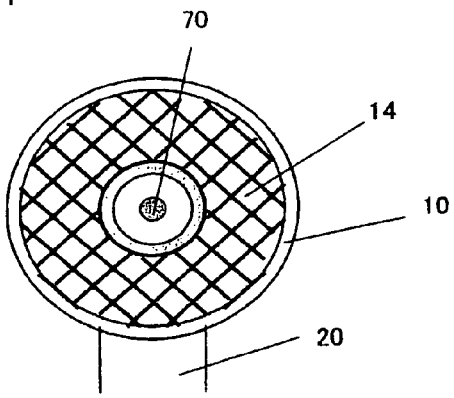
FIG. 4 is a front view of an electrostatic atomizing hairdryer in accordance with the first and second embodiments.

FIG. 4 is a front view of the main body 10 of the hairdryer 1 in accordance with the first and second embodiments. In the first embodiment shown in FIG. 1 and in the second embodiment shown in FIG. 2, the electrode unit 60 is provided at substantially the center of the main body 10 in a front view. Especially, in the second embodiment where the electrode unit 60, the tank 61 and the mist emitting opening member 70 are unified as the cartridge 7 which is detachable from the main body 10, putting on and taking off of the cartridge 7 can be made easier by constituting the grating of the air exit opening 14 detachable or openable. Alternatively, by providing the grating of the air exit opening 14 at a position upstream side of the airflow from the mist emitting opening member 70, putting on and taking off of the cartridge 7 can be made easier.

Figure 5:
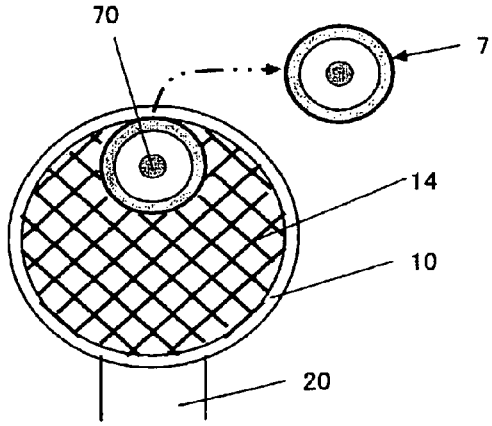
FIG. 5 is a front view showing another constitutional example of the electrostatic atomizing hairdryer in accordance with the first and second embodiments.

In addition, the cartridge 7 may be provided at a position facing the outer periphery of the main body such as at upper portion, lower portion or side portion of the main body 10 of the hairdryer 1 as shown in FIG. 5. In such a case, the cartridge 7 can be detached from the upper portion, lower portion or side portion of the main body 10. Furthermore, it is possible to configure that the electrode part 60 and the mist emitting opening member 70 are fixed on the main body 10, and only the tank 61 is detachable, similar to the first embodiment. Alternatively, it is possible to configure that the tank 61 is further fixed on the main body 10, and the liquid inlet 62 is provided on the outer periphery of the main body 10.

Figure 6:
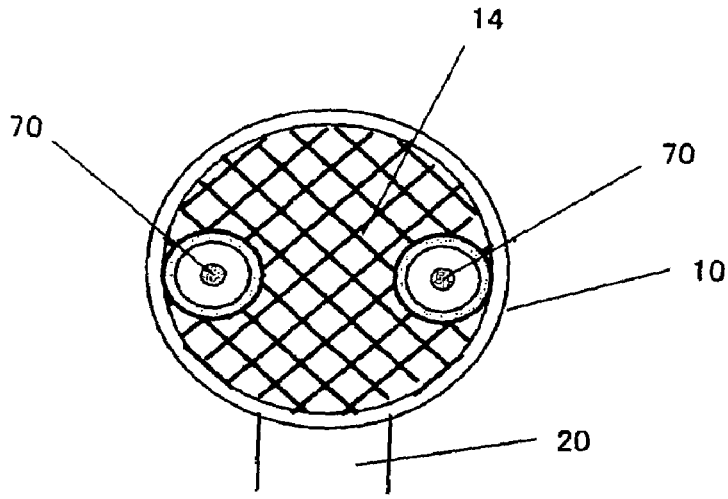
FIG. 6 is a front view showing still another constitutional example of the electrostatic atomizing hairdryer in accordance with the first and second embodiments.
Figure 7:
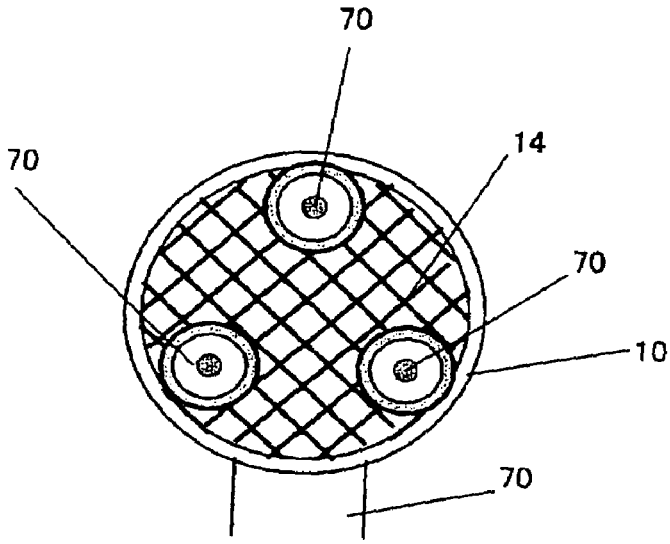
FIG. 7 is a front view showing still another constitutional example of the electrostatic atomizing hairdryer in accordance with the first and second embodiments.

FIG. 6 and FIG. 7 respectively show constitutional examples that the electrode units 60 and the mist emitting openings 70 (including the case of the cartridges 7) are provided at two places and three places. In these cases, it is preferable that the electrode units 60 and the mist emitting openings 70 are arranged evenly at a predetermined angle so that the mist is evenly scattered into the airflow emitted from the hairdryer 1. It, however, may be configured that two or more sets of the electrode units 60 and the mist emitting openings 70 are disposed in neighborhood in consideration with the configuration for feeding the liquid from the tank 61 or for applying a voltage from the high voltage generating circuit 67. In such a case, it is possible to use a single opposing electrode 66 commonly. Still furthermore, a plurality of tanks 61 may be provided corresponding to a number of the electrode units 60 and the mist emitting openings. Alternatively, the liquid may be fed to the electrode units 60 through a plurality of liquid feed pipes 64 from a single tank 61.

Third Embodiment

Figure 8:
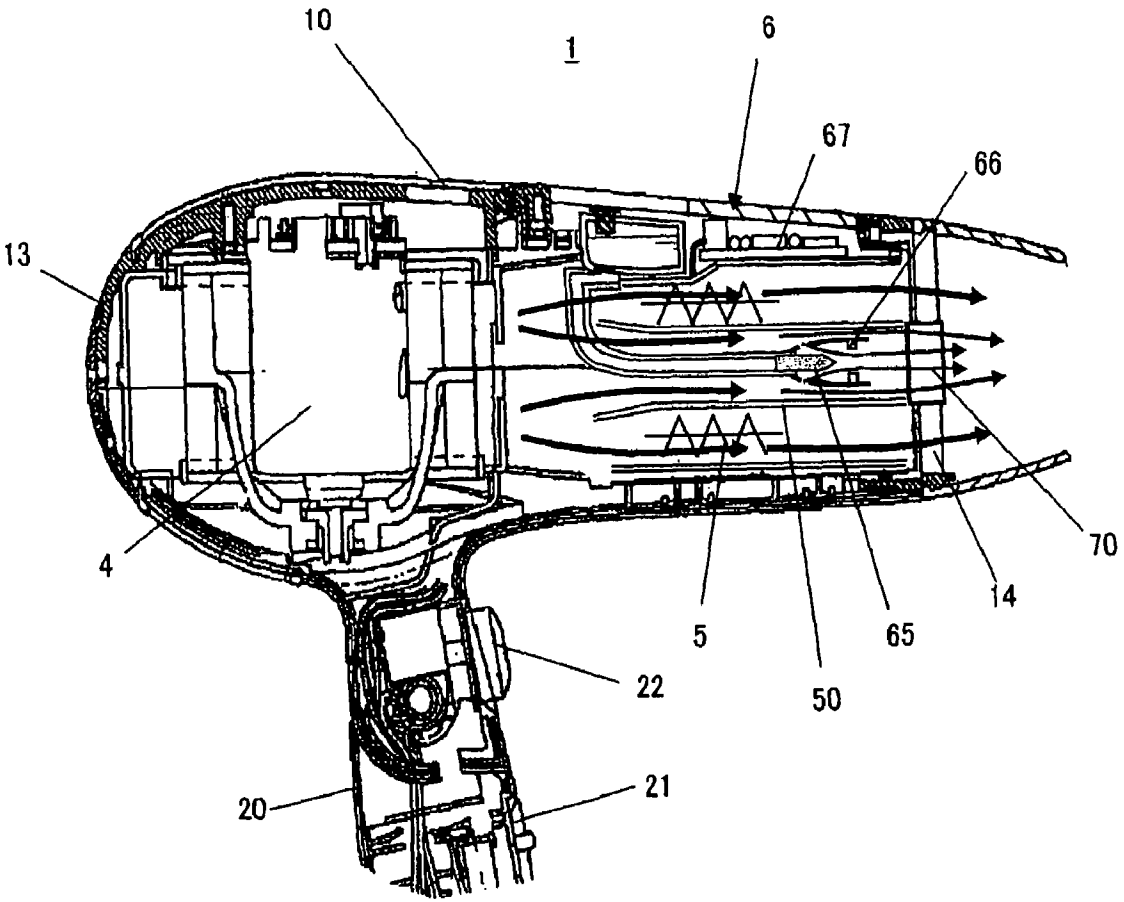
FIG. 8 is a sectional view showing a constitutional example of an electrostatic atomizing hairdryer in accordance with a third embodiment of the present invention.
Figure 9:
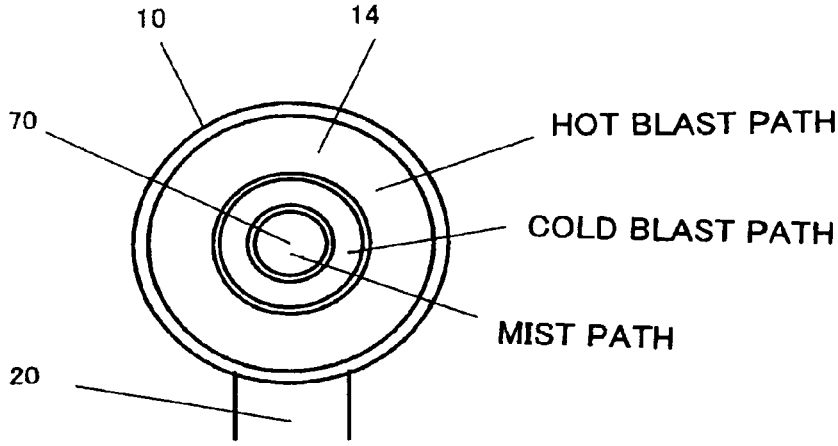
FIG. 9 is a front view showing paths of a hot blast, a cold blast and electrostatically atomized mist emitted from the electrostatic atomizing hairdryer in accordance with the third embodiment.

Subsequently, an electrostatic atomizing hairdryer 1 in accordance with a third embodiment of the present invention is described. FIG. 8 is a sectional view showing a configuration of the hairdryer 1 in accordance with the third embodiment. In the third embodiment, a part of the airflow generated by the blower 4 is introduced into an inside of the adiabator 50 so as to pass the airflow without being heated by the heating unit 5. Therefore, it is configured that the cold blast is generated inside the hot blast and the electrostatically atomized mist is further generated inside the cold blast, as shown in FIG. 9. Since the cold blast which is not heated by the heating unit 5 passes the outside of the electrode unit 60, it is possible to prevent the leakage of the liquid from the liquid feed pipe 64 due to expansion of the liquid corresponding to temperature rise by the hot blast, and to prevent the evaporation of the mist generated in the electrode unit 60.

Furthermore, it is possible to constitute that a part of the cold blast passing through the inside of the adiabator 50 is sucked into the inside of the electrode unit 60 by providing slits on the electrode unit 60. In the latter case, the mist generated in the electrode unit 60 is further pushed out from the mist emitting opening 70 by the airflow sucked into the inside of the electrode unit 60. Consequently, the mist generated in the electrode unit 60 rarely disappears in the vicinity of the opposing electrode 66, so that the mist is scattered into the airflow emitted from the air exit opening 14 of the main body 10 of the hairdryer 1.

Fourth Embodiment

Figure 10:
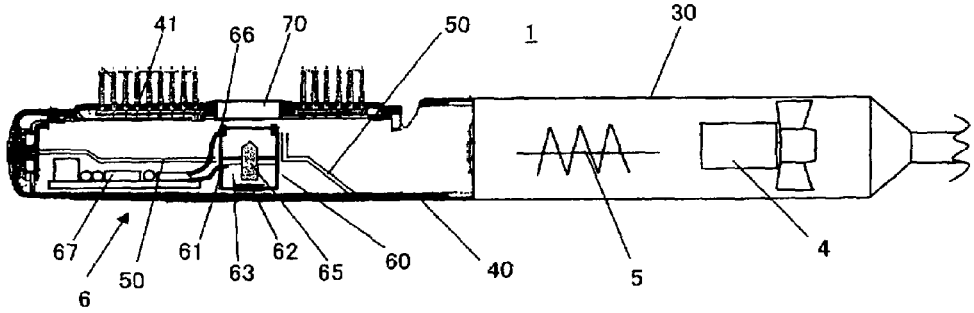
FIG. 10 is a sectional view showing a constitutional example of an electrostatic atomizing hairdryer in accordance with a fourth embodiment of the present invention.

Subsequently, an electrostatic atomizing hairdryer 1 in accordance with a fourth embodiment of the present invention is described. The fourth embodiment relates to a hairdryer 1 with a brush. FIG. 10 is sectional view showing a configuration of the hairdryer 1 with a brush in accordance with the fourth embodiment.

In the hairdryer 1, a brush unit 40 is detachably attached as an attachment to a main body 30 in which the blower 4 and the heating unit 5 are provided. The electrostatic atomizing unit 6 is provided in an inside of the brush unit 40 so that it is insulated from heat by the adiabator 50. In addition, the electrode unit 60 and the mist emitting opening 70 are provided at substantially the center portion of a brush 41.

The positions of the electrode unit 60 and the mist emitting opening 70 are not limited to substantially the center portion of the brush unit 40, so that they can be positioned at various portions in the brush unit 40 such as at a front end portion or a root portion of the brush unit 40 that is thermally insulated by the adiabator 50. Furthermore, with respect to a number of the electrode units 60 and the mist emitting openings 70, they can be provided at a plurality of positions such as both of the front end portion and the root portion of the brush unit 40.

Figure 11:
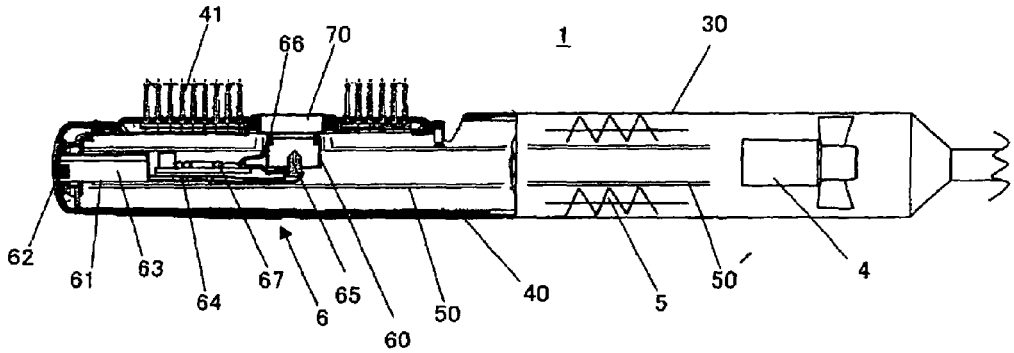
FIG. 11 is a sectional view showing another constitutional example of the electrostatic atomizing hairdryer in accordance with the fourth embodiment.

In a constitutional example shown in FIG. 11, a tubular shaped adiabator 50 is provided at substantially the center of the brush unit 40, and the electrostatic atomizing unit 6 is provided in the inside of the adiabator 50. Furthermore, another tubular shaped adiabator 50' is further provided at a position facing the heating unit 5 in the main body 30, so that a part of airflow generated by the blower 4 passes through the inside of the adiabator 50' without being heated by the heat from the heating unit 5. Then, the cold blast emitted from the main body 30 is introduced into the inside of the adiabator 50 in the brush unit 40. By such a configuration, the mist generated in the electrode unit 60 is sucked outward from the mist emitting opening 70 be negative pressure generated in the vicinity of the mist emitting opening 70 due to the airflow passing the inside of the adiabator 50, similar to the above third embodiment. In addition, it is possible to configure that slits are formed on the electrode unit 60 so as to introduce a part of the cold blast passing the inside of the adiabator 50 into the inside of the electrode unit 60. In such a case, the mist generated in the electrode unit 60 is pushed toward the outside from the mist emitting opening 70 by the airflow introduced into the electrode unit 60. Consequently, the mist outwardly sprayed from the mist emitting opening 70 is scattered into the airflow emitted from the gaps of the brush 41 effectively.

Figure 12:
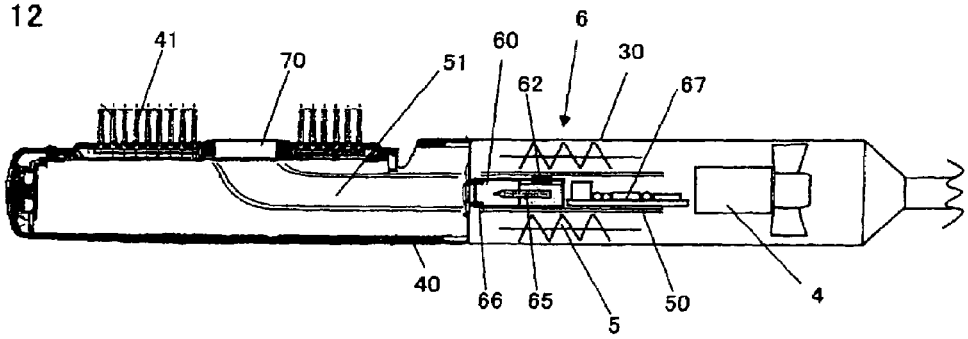
FIG. 12 is a sectional view showing still another constitutional example of the electrostatic atomizing hairdryer in accordance with the fourth embodiment.

In a constitutional example shown in FIG. 12, a tubular shaped adiabator 50 is provided at a position opposing the heating unit 5 in the main body 30, and the electrostatic atomizing unit 6 is provided in the inside of the adiabator 50. Furthermore, the brush unit 40 comprises the mist emitting opening 70 provided at substantially the center of the brush 41 and an adiabator 51 having substantially J-shaped section and connecting an exit portion of the adiabator 50 in the main body 30 and the mist emitting opening 70. In addition, it is preferable to restrain electrification by spreading antistatic agent on the adiabator 51 or grounding the adiabator 51. According to such a configuration, since the electrostatic atomizing unit 6 is provided on the main body 30, even though various shaped brush 40 is used as an attachment, the airflow into which the mist is effectively scattered can be emitted.

Fifth Embodiment

Figure 13:
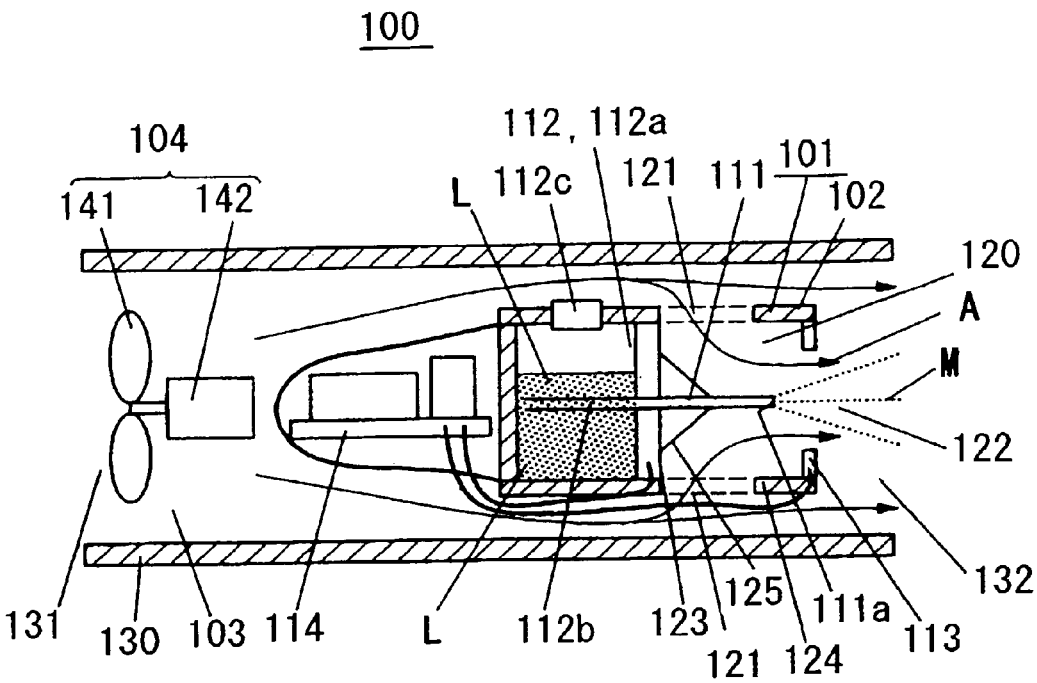
FIG. 13 is a sectional view showing a configuration of an electrostatic atomizer in accordance with a fifth embodiment of the present invention.

Subsequently, an electrostatic atomizer 100 in accordance with a fifth embodiment of the present invention is described with reference to figures. FIG. 13 shows a basic configuration of the electrostatic atomizer 100 in accordance with the fifth embodiment.

A housing 130 for airflow path, which forms an airflow path 103 of the electrostatic atomizer 100, has, for example, a substantially cylindrical shape, and an air suction opening 131 from which air is sucked is formed at an end of the housing 130 and an air exit opening 132 from which air is emitted is formed at the other end of the housing 130. A space between the air suction opening 131 and the air exit opening 132 serves as the airflow path 103. In addition, the shape of the housing 130 for airflow path is not limited to the substantially cylindrical shape, and it is possible that an outer shell casing of the electrostatic atomizer 100 may serve as the housing 130 for airflow path, directly.

A blower 104 comprised of a fan 141, a motor 142, and so on is provided at a position upstream side of the airflow path 104, that is, in the vicinity of the air suction opening 131, so that air can be sucked into the inside of the housing 130 for airflow path from the air suction opening 131 and emit the airflow from the air exit opening 132. Furthermore, an electrostatic atomizing unit 101 is provided at a position downstream side from the blower 104 in the airflow path 103.

Figure 19:
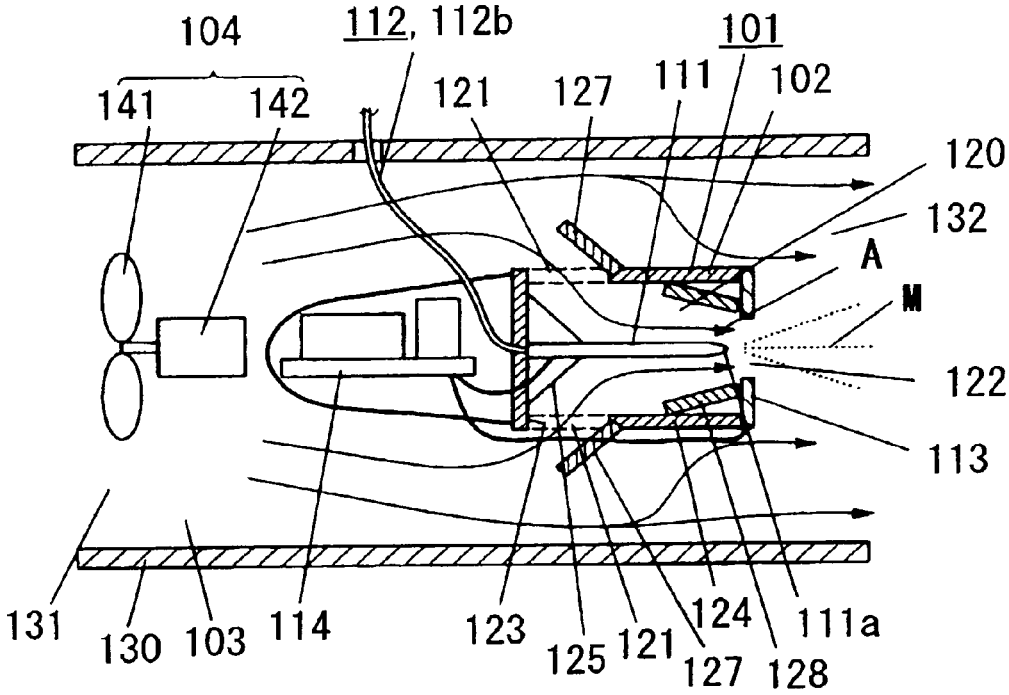
FIG. 19 is a sectional view showing another configuration of the electrostatic atomizer in accordance with the fifth embodiment.

The electrostatic atomizing unit 101 is comprised of an atomizing electrode 111, a liquid feeder 112, an opposing electrode 113, a voltage applying circuit 114, and so on. The atomizing electrode 111 and the opposing electrode 113 are further contained in a housing 102 for electrostatic atomization. As shown in FIG. 13, a tank 112*a* of the liquid feeder 112 and the voltage applying circuit 114 are unified at a position upstream side of the housing 102 for electrostatic atomization. Alternatively, the tank 112*a* may be provided separately from the housing 102 for electrostatic atomization, as shown in FIG. 19.

The housing 102 for electrostatic atomization has a substantially cylindrical shape, and a space 120 serving as an airflow path is formed in an inside thereof. The atomizing electrode 111 and the opposing electrode 113 are further contained in the space 120. The housing 102 for electrostatic atomization is disposed in the inside of the housing 130 for airflow path so that the center axis of the cylindrical shape orients along the direction of the airflow in the housing 103 for airflow path. A tapered portion 125 having a diameter becoming smaller for downstream side is provided on an inner end wall 123 disposed at upstream side of the airflow path 102 in the space 120 of the housing 102 for electrostatic atomization. The tapered portion 125 has a substantially circular cone shape, and the peak of the circular cone is positioned at the end of downstream side of the airflow in the housing 103 for airflow path. The atomizing electrode 111 is provided for protruding from the peak of the tapered portion 125 toward the downstream side of the airflow. It is preferable that a length or height of the tapered portion 125 in the direction of the airflow is made equal to or shorter than 80% of the protruded length of the atomizing electrode 11 from the inner end wall 123. Thereby, it is possible to prevent that the tapered portion 125 affects to convergence of electric field to a front end 111*a* of the atomizing electrode 111, so that the discharge at the front end 111*a* of the atomizing electrode 111 can be generated effectively. Alternatively, when the tapered portion 125 is formed of a material which is hard to be electrostatically charged, that is a material to which electrostatically charged mist M rarely adhered, the length of the tapered portion 125 can be made equal to or longer than 80% of the protruded length of the atomizing electrode 11.

The atomization electrode 111 is needle shape or stick shape, and whole of the atomization electrode 111 is formed of porous material, or a transportation path of liquid L is formed thereon. Thereby, the liquid L can be fed to the front end 111*a* of the atomizing electrode 111 from the tank 112*a* by capillary phenomenon. Then, the mist M is generated by electrostatically atomizing the liquid L at the front end 111*a* of the atomizing electrode 111. The opposing electrode 113 is disposed at a position downstream side from the front end 111*a* of the atomizing electrode 111.

The opposing electrode 113 has a substantially ring shape, and formed of, for example, a resin containing conductive material such as carbon or a metal such as SUS. In the constitutional example shown in FIG. 13, the opposing electrode 113 serves as a wall of the housing 102 for electrostatic atomization t downstream side, and a center hole of the opposing electrode 113 serves as a mist emitting opening 122 through which the mist M is emitted from the space 120 of the housing 102 for electrostatic atomization. It is preferable to set an inner diameter of the mist emitting opening 122 to 3 to 10 mm extent. Thereby, it becomes difficult to enter an extraneous material such as a finger or metal piece into the inside of the housing 102 for electrostatic atomization, so that electric shock or electric leakage can be prevented. Furthermore, no turbulent flow due to insertion of extraneous material occurs, so that the mist M can be sprayed effectively.

Introduction openings 121 for introducing air into the space 120 of the housing 102 for electrostatic atomization are formed at a plurality of positions on a side wall 124 of the housing 102 for electrostatic atomization which is substantially the cylindrical shape at a predetermined angle in circumference direction. The position of each introduction opening 121 in the direction of the airflow in the housing 103 for airflow path is located from a portion substantially facing the inner end wall 123 from which the atomizing electrode 111 is protruded (or the root portion of the tapered portion 125) to a portion substantially facing the front end 111*a* of the atomizing electrode 111 or more upstream side there from in the flowing direction of airflow in the airflow path. More specifically, each introduction opening 121 is a rectangular shape having at least a side of 2 to 10 mm. For example, two introduction openings 121 are formed on the side wall 124 of the cylindrical shaped housing 102 for electrostatic atomization at angular interval of 180 degrees. Alternatively, three introduction openings 121 are formed at angular interval of 120 degrees, four introduction openings 121 are formed at angular interval of 90 degrees, five introduction openings 121 are formed at angular interval of 72 degrees, and so on.

The liquid feeder 112 is comprised of a tank 112*a* for storing the liquid L, a transportation unit 112*b* for transporting the liquid L from the tank 112*a* to the atomizing electrode 111, and so on. The tank 112*a* of the liquid feeder 112 may be unified with the housing 102 for electrostatic atomization at upstream portion or downstream portion in the airflow in the housing 102 for electrostatic atomization. Alternatively, the tank 112*a* may be unified with the housing 102 for electrostatic atomization at side portion of the housing 102 for electrostatic atomization. Alternatively, the tank 112*a* may be provided apart from the housing 102 for electrostatic atomization. In FIG. 13, a numeric reference 112*c* designates a cap of a liquid inlet from which the liquid L is filled into the tank 112*a*.

In the example shown in FIG. 13, the atomizing electrode 111 is formed long toward the tank 112*a* so that it has a function not only the inherent function of the atomizing electrode but also the function of the transportation unit 112*b* of liquid L. On the other hand, in the case shown in FIG. 19, the transportation unit 112*b* having a circular section or elliptic section of a diameter less than 2 mm is provided for transporting the liquid L to the atomizing electrode 111 by capillarity separately from the atomizing electrode 111. Thereby, the airflow is rarely disturbed when the airflow passing in the airflow path 103 is introduced into the housing 102 for electrostatic atomization from the introduction openings 121, so that the airflow can be introduced more uniformly into the housing 102 for electrostatic atomization.

As for the liquid feeder 112, when the liquid L is water, it is not always necessary to provide the tank 112*a*, and it is sufficient that atmospheric moisture can be adhered on the front end 111*a* of the atomizing electrode 111. For example, it is possible to condense the atmospheric moisture at the front end 111*a* of the atomizing electrode 111 with using cooling means such as an absorbent or a Peltier device. In such a case, the transport capacity of water of the absorbent or the Peltier device to the front end 111*a* of the atomizing electrode 111 is inferior to that of the case that the water is fed from the tank 112*a*, so that it is necessary so that the front end 111*a* of the atomizing electrode 111 is never be located in the airflow.

The voltage applying circuit 114 applies a high voltage between the atomizing electrode 111 and the opposing electrode 113. The voltage applying circuit 114 may be provided integrally with or independently from the housing 102 for electrostatic atomization, as shown in FIG. 13 or 19.

Subsequently, a motion of the electrostatic atomizer 100 is described. It is assumed that the liquid L is fed from the liquid feeder 112 from the front end 111*a* of the atomizing electrode 111. Under such a condition, when the opposing electrode 113 is grounded and a high voltage of several kV is applied between the atomizing electrode 111 and the opposing electrode 113, water at the front end 111*a* of the atomizing electrode 111 receives large energy due to large electric field and Rayleigh disrupture that repeats the disrupture of water occurs, so that electrostatically atomized mist M of nanometer size having activated species with reactivity is generated. The electric field is generated from the front end 111*a* of the atomizing electrode 111 toward the opposing electrode 113. Since the mist M is electrostatically charged before electrostatically atomized, the mist generated at the front end 111*a* of the atomizing electrode 111 moves toward the opposing electrode 113 of antipolarity by electrostatic force received from the electric field.

On the other hand, air is sucked from the air suction opening 131 of the housing 130 for airflow path by the blower 104 so that the airflow occurs in the airflow path 103. A part of the airflow is further introduced into the housing 102 for electrostatic atomization from the introduction openings 121. The airflow introduced into the housing 102 for electrostatic atomization from the introduction openings 121 flows in a direction substantially perpendicular to the axis of the housing 102 for electrostatic atomization, first. The direction of the airflow, however, is changed to a direction substantially parallel to the axis of the housing 102 for electrostatic atomization by the tapered portion 125 formed on the inner end wall 123 at upstream side in the housing 102 for electrostatic atomization. Then, the mist M generated at the front end 111*a* of the atomizing electrode 111 is efficiently emitted from the mist emitting opening 122 as shown by arrow A due to electrostatic force acting toward the opposing electrode 113 and the airflow.

Figure 14:
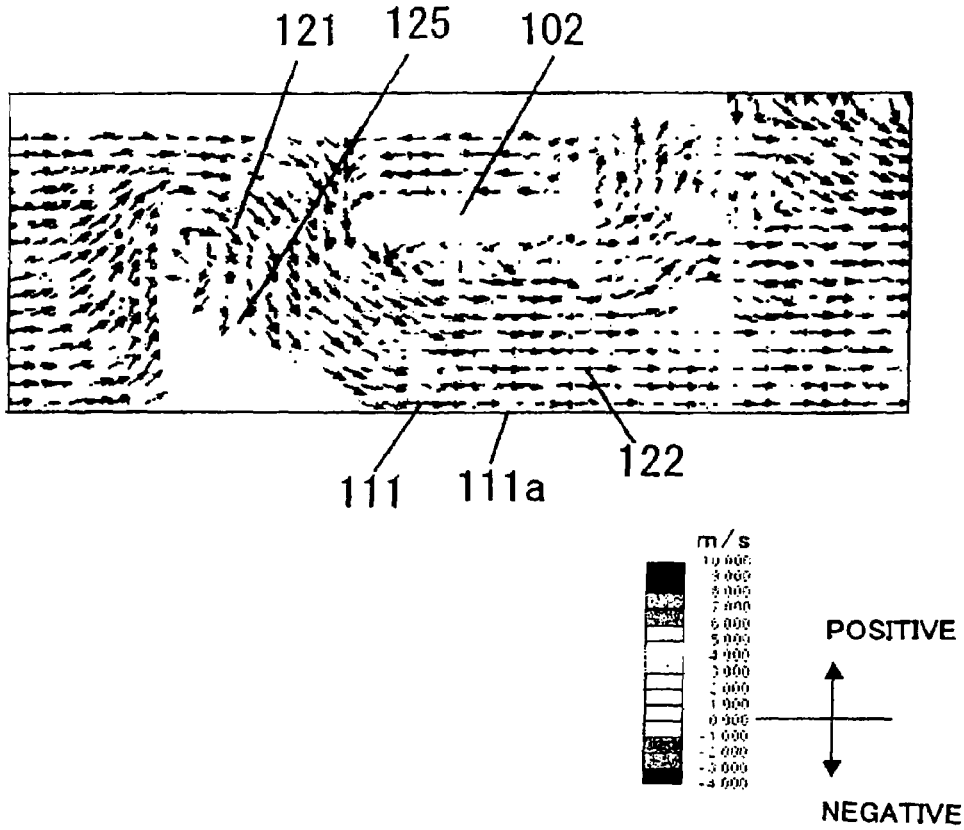
FIG. 14 is a vector diagram showing a result on analysis of airflow when introduction openings and a tapered portion are provided in a housing for electrostatic atomization in the electrostatic atomizer in accordance with the fifth embodiment.
Figure 15:
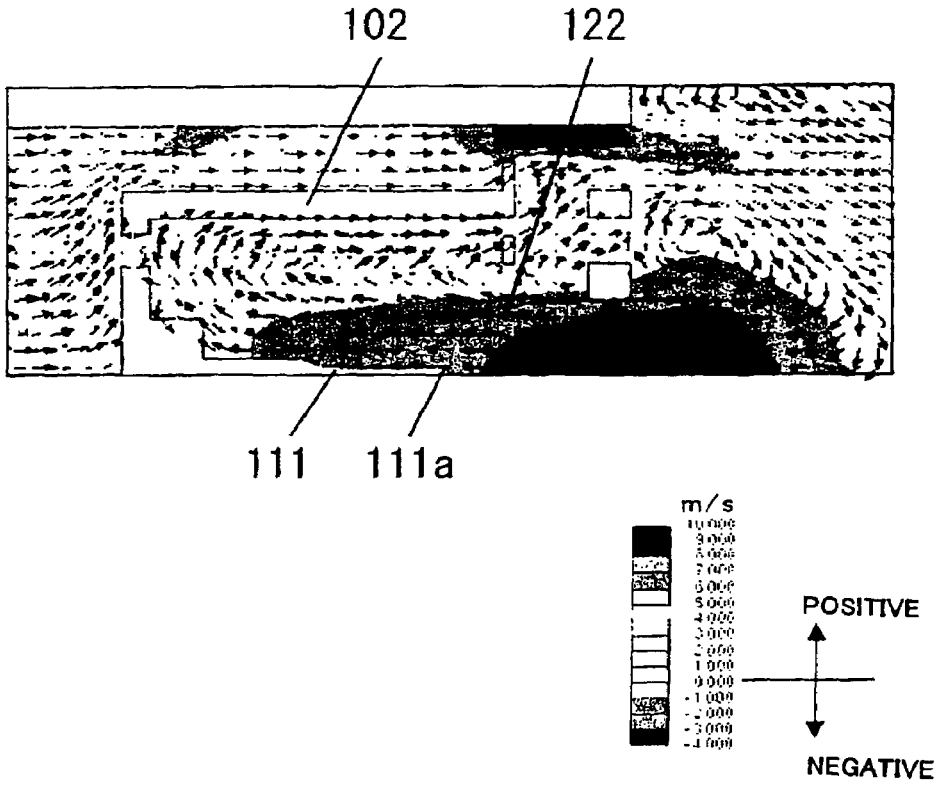
FIG. 15 is a vector diagram showing a result on analysis of airflow when no introduction opening and no tapering portion are provided in the housing for electrostatic atomization.

Subsequently, a result of analysis of the airflow when the introduction openings 121 and the tapered portion 125 are provided on the housing 102 for electrostatic atomization is shown in FIG. 14. As a comparative example, a result of analysis of the airflow when the introduction openings 121 and the tapered portion 125 are not provided on the housing 102 for electrostatic atomization is shown in FIG. 15. As can be seen from FIG. 15, when the introduction openings 121 and the tapered portion 125 are not provided, airflow occurs backward from the mist emitting opening 122 of the housing 102 for electrostatic atomization, and airflow occurs backward in the vicinity of the front end 111*a* of the atomizing electrode 111. On the contrary, as can be seen from FIG. 14, when the introduction openings 121 and the tapered portion 125 are provided, the airflow introduced from the introduction openings are change the flowing direction thereof by the tapered portion 125, and emitted from the mist emitting opening 122, as it is. Therefore, it is found that no backward airflow occurs and the airflow is effectively emitted from the mist emitting opening 122.

Figure 16:
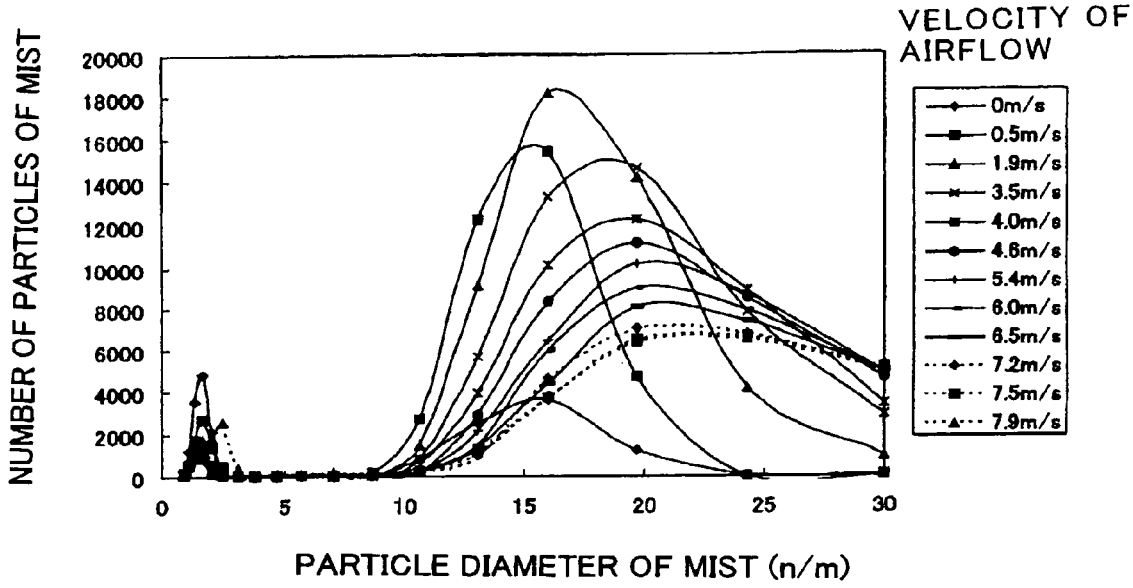
FIG. 16 is a graph showing variations of particle size of mist emitted from a mist emitting opening and number of particles of mist with respect to velocity of airflow passing through the housing for electrostatic atomization.
Figure 17:
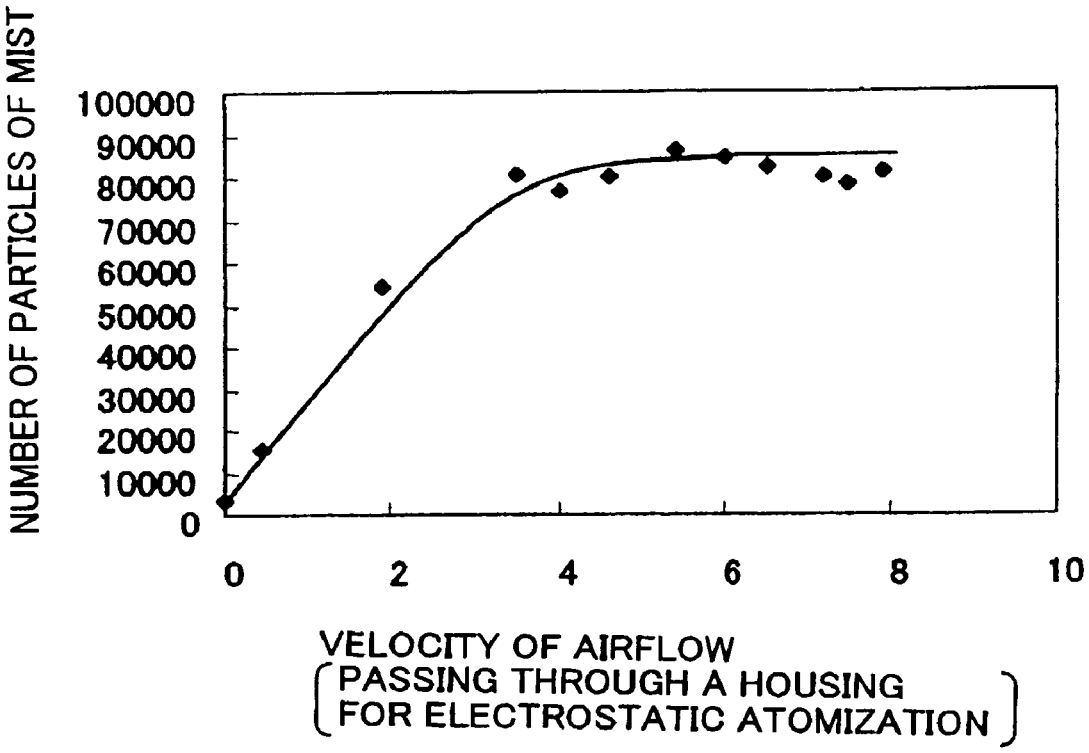
FIG. 17 is a graph showing a relationship between number of particles of mist emitted from the mist emitting opening and velocity of the airflow passing through the housing for electrostatic atomization.

Subsequently, a relation between a diameter of a particle and a number of particles of the mist M emitted from the mist emitting opening 122 at each velocity of airflow passing through the electrostatic atomizing unit 101 (or the housing 102 for electrostatic atomization) is shown in FIG. 16. In addition, a relation between the number of particles of the mist M emitted from the mist emitting opening 122 and a velocity of the airflow passing through the electrostatic atomizing unit 101 (or the housing 102 for electrostatic atomization) is shown in FIG. 17. For measurement, DMA (Derivative particle size Measuring Apparatus) was used, and diameters and numbers of particles of the mist M emitted from the mist emitting opening 122 were measured.

As can be seen from FIG. 17, the number of particles of the mist M emitted from the mist emitting opening 122 was increased until the velocity of the airflow passing through the housing 102 for electrostatic atomization reached to 4 m/s. It is considered that the mist M generated at the front end 111*a* of the atomizing electrode 111 has not been emitted effectively until the velocity of the airflow reached to 4 m/s, so that the number of particles of the mist M was not so large. However, when the mist M has been emitted effectively corresponding to the increase of the velocity of the airflow, the number of particles of the mist M has been increased. In addition, even when the velocity of the airflow has increased more than 4 m/s, the number of particle of the mist M has been increased little, It is considered that almost all the mist M generated at the front end 111*a* of the atomizing electrode 111 has been emitted effectively by the airflow having the velocity more than 4 m/s.

In this way, by providing the introduction openings 121 on the housing 102 for electrostatic atomization, the airflow can be introduced into the inside of the housing 102 for electrostatic atomization. Thus, the mist M generated at the front end 111*a* of the atomizing electrode 111 can be emitted outward from the mist emitting opening 122 of the housing 102 for electrostatic atomization. Consequently, quantity of scattered mist M from the electrostatic atomizer 100 can be increased. Furthermore, the introduction openings 121 are formed on the side wall 124 of the housing 102 for electrostatic atomization in a portion between the inner end wall 123 and the front end 111*a* of the atomizing electrode 111 in the flowing direction of the airflow (or in the axial direction of the housing 102 for electrostatic atomization), so that it is possible to prevent the occurrence of the turbulent flow in the vicinity of the front end 111*a* of the atomizing electrode 111. Consequently, it is possible to reduce the pressure loss of the airflow when the airflow passes through the housing 102 for electrostatic atomization. Still furthermore, the tapered portion 125 having a diameter gradually smaller for the downstream side of the airflow is provided on the inner end wall 123 of the housing 120 for electrostatic atomization, so that the direction of the airflow introduced into the housing 102 for electrostatic atomization can be changed smoothly to the direction substantially parallel to the center axis of the housing 102 for electrostatic atomization, and toward the downstream side of the airflow passing through the housing 103 for airflow path. Consequently, it is possible to prevent the occurrence of the turbulent flow in the vicinity of the base end of the protrusion of the atomizing electrode 111.

Still furthermore, with forming a plurality of introduction openings 121 along the outer periphery of the cylindrical shaped housing 102 for electrostatic atomization with an equal spacing and with shaping each introduction opening 121 as rectangular shape having a length of 2 to 10 mm in the axial direction of the housing 102 for electrostatic atomization, it is possible to change the direction of the airflow which flows toward the center axis of the housing 102 for electrostatic atomization from outside to the axial direction of the housing 102 for electrostatic atomization by the tapered portion 125.

Figure 18A:
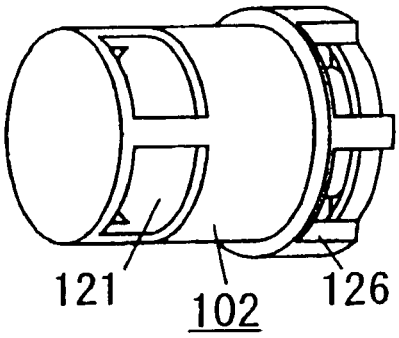
FIG. 18A is a perspective view showing a housing for electrostatic atomization established a protection member for preventing entering of extraneous material in the electrostatic atomizer in accordance with the fifth above embodiment.
Figure 18B:
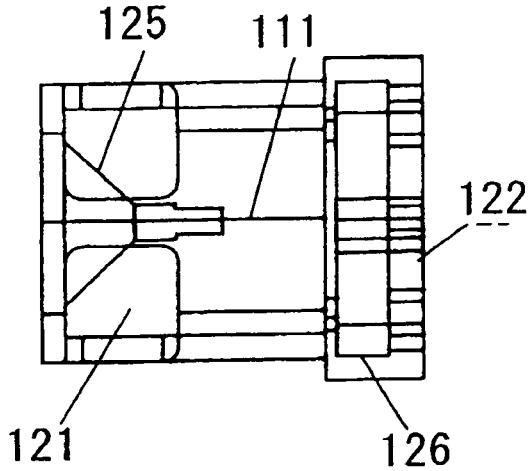
FIG. 18B is a sectional view thereof.

Still furthermore, it is possible to provide a protection member 126 for preventing that extraneous material such as a finger or metal piece is inserted into the mist emitting opening 122 of the housing 102 for electrostatic atomization, as shown in FIGS. 18A and 18B. The protection member 126 is attached to an end of the housing 102 for electrostatic atomization at downstream side of the airflow, and has a plurality of openings of a diameter (for example, 3 to 10 mm extent) smaller that that of the mist emitting opening 122 of the housing 102 for electrostatic atomization. Alternatively, a grating member (not shown) may be attached as the protection member 126. In these cases, it is preferable that the protection member 126 is formed of a material such as a resin of silicon system, resin of organic boron system, or macromolecule resin, which is hard to be electrostatically charged. Alternatively, it is preferable that the grating member is grounded or a voltage much smaller than the voltage applied to the opposing electrode by the voltage applying circuit 114 so as to restrain that the grating member is electrostatically charged. Still furthermore, it is preferable to select a width of the grating as 1 to 2 mm extent so as not to intercept the airflow but to secure mechanical intensity. By providing the protection member 126, it is possible not only to prevent electric shock or electric leakage due to insertion of extraneous material such as a finger or metal piece but also to emit the mist M effectively without turbulence of the airflow due to the insertion of extraneous material.

In the above example shown in FIG. 13, the opposing electrode 113 serves as an inner end wall at downstream side of the space 120 of the housing 102 for electrostatic atomization, and the center opening of the opposing electrode 113 serves as the mist emitting opening 122, too. However, when the protection member 126 is further provided as shown in FIGS. 18A and 18B, it is preferable to form that the mist emitting opening 122 of the housing 102 for electrostatic atomization and the center opening of the opposing electrode 113 substantially the same size as or a little different from each other, for example, having a diameter of 8 mm extent. Furthermore, when the introduction openings 121 are formed on the side wall 124 of the housing 102 for electrostatic atomization, it is preferable to make an open area of the mist emitting opening 122 smaller, since the airflow introduced into the inside of the housing 102 for electrostatic atomization concentrative flows in the center portion. On the other hand, in case that the introduction openings 121 are formed on the inner end wall 123 at upstream side of the housing for electrostatic atomization (not shown), the airflow introduced from the introduction opening will be expanded in the inside of the housing 102 for electrostatic atomization, so that it is preferable to make an open area of the mist emitting opening 122 larger.

Subsequently, a constitutional example shown in FIG. 19 is described. In the electrostatic atomizer 100 shown in FIG. 19, an introduction guide 127 to introduce the airflow flowing in the airflow path 103 into the inside of the housing 102 for electrostatic atomization is provided in a neighborhood of the introduction openings 121 on the outer periphery of the housing 102 for electrostatic atomization. The introduction guide 127 is slanted so that upstream side portion projects outward from an edge at downstream side of the introduction openings 121 on the outer periphery of the housing 102 for electrostatic atomization. Therefore, even when a quantity of airflow flowing in the airflow path 103 is smaller, it is possible to increase a quantity of the airflow introduced into the housing 102 for electrostatic atomization as much as possible, and consequently, a quantity of the mist emitted from the electrostatic atomizer 100 can be assured.

In addition, a tapered guide 128 having a diameter gradually becoming smaller for the mist emitting opening 122 is provided in the inside of the housing 102 for electrostatic atomization at a portion between the introduction opening 121 and the mist emitting opening 122. Therefore, it is possible to prevent the occurrence of turbulent flow due to collision of the airflow on the inner side wall of the housing 102 for electrostatic atomization in the downstream portion from the introduction openings 121.

Figure 20:
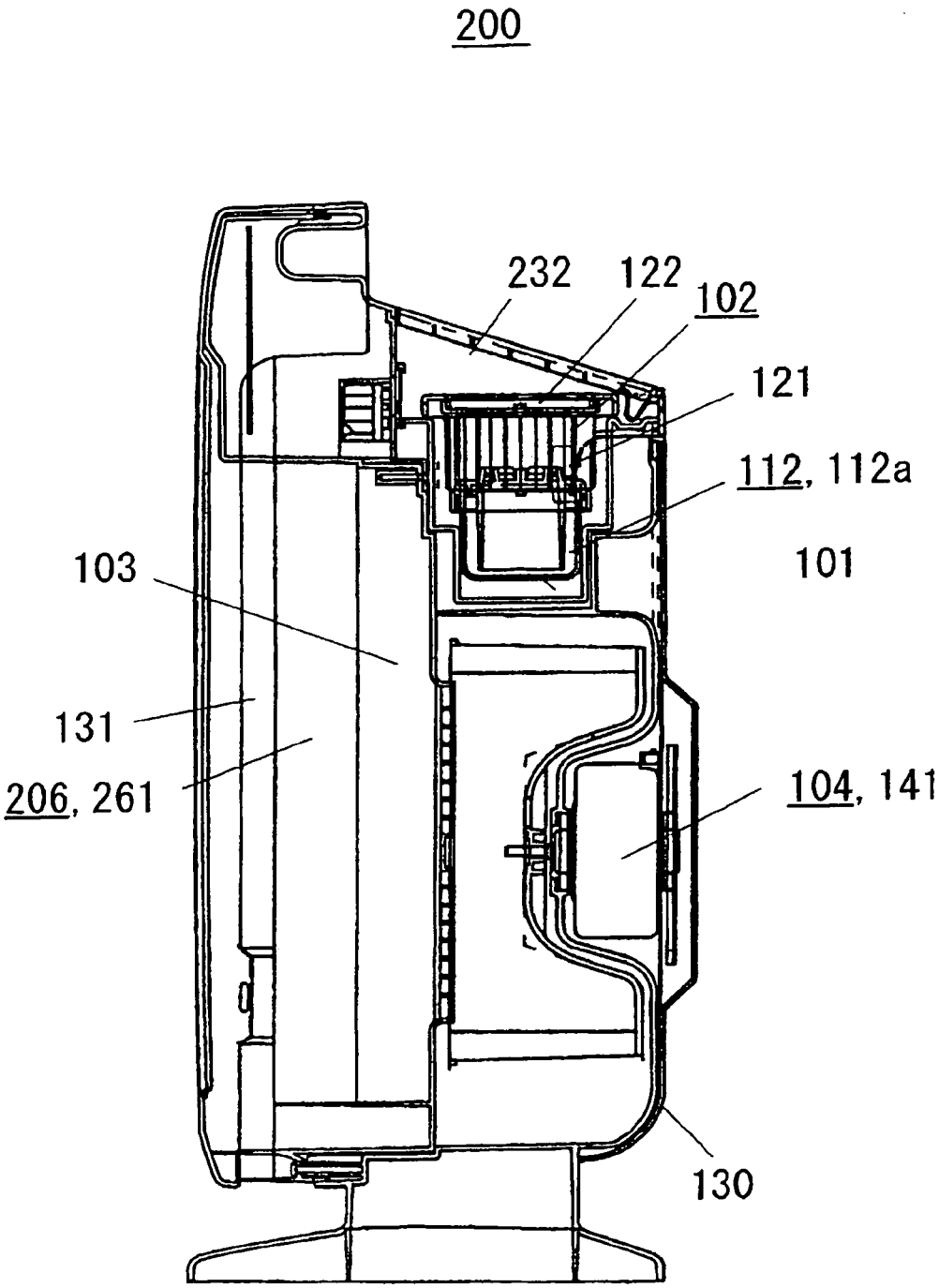
FIG. 20 is a sectional view showing a configuration of an air cleaner comprising an electrostatic atomizer in accordance with the fifth embodiment.

By the way, as for a manufacture comprising the above-mentioned electrostatic atomizer 100, an air cleaner is noticed further to the hairdryer. FIG. 20 shows an air cleaner 200 comprising the electrostatic atomizer. As shown in FIG. 20, an outer shell casing of the air cleaner 200 served as the housing 130 for airflow path, and air is sucked into the airflow path 103 from the air suction opening 131 by the blower 104 provided in the airflow path 103. An air cleaning unit 206 that is constituted by a filter 261 and so on is disposed in upstream side in the airflow path 103 from the blower 104. The electrostatic atomizing unit 101 is disposed in downstream side in the airflow path 103 from the blower 104. The mist M emitted from the mist emitting opening 122 of the electrostatic atomizing unit 101 is further emitted from the exit opening 232 of the air cleaner 200. Deodorization such as indoor air or deposits on an indoor wall surface is performed by the mist M.

Figure 21:
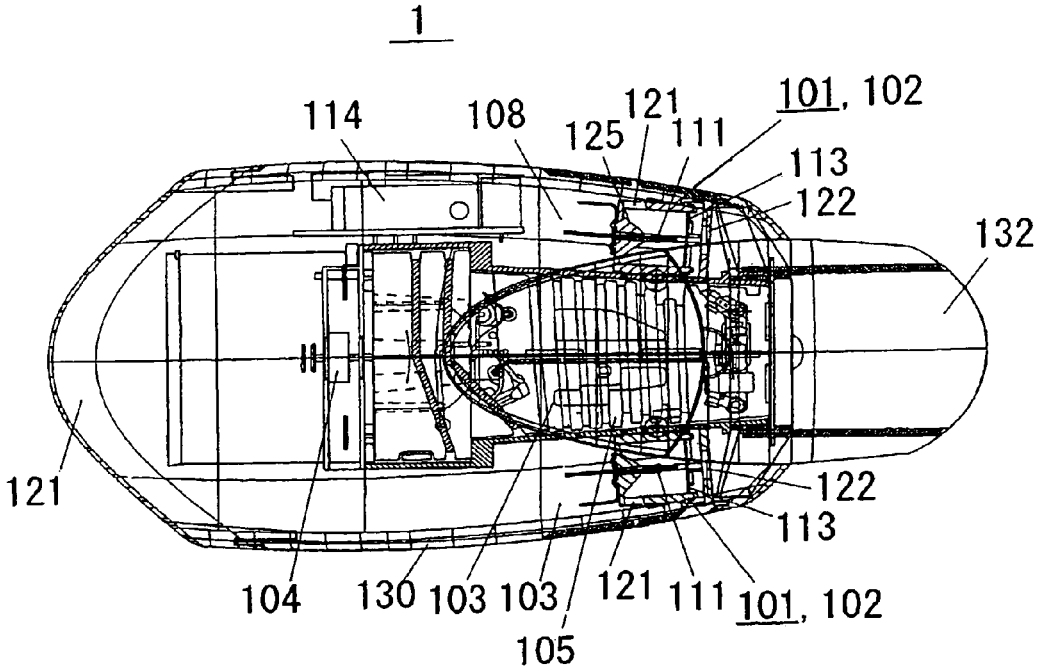
FIG. 21 is a plane sectional view showing a configuration of a hairdryer comprising an electrostatic atomizer in accordance with the fifth embodiment.

FIG. 21 shows another constitutional example of the hairdryer 1 comprising the electrostatic atomizer 100. In case of this hairdryer 1, the outer shell casing thereof serves as the housing 130 for airflow path, and air is sucked into the airflow path 103 from the air suction opening 131 by the blower 104 disposed in upstream side of the airflow path 103. An airflow path 103' is branched out toward the heating unit 105 from a midway of the airflow path 103 toward the electrostatic atomizer 100. The electrostatic atomizer 100 and the heating unit 105 are provided on each airflow paths, but the airflow paths 103 and 103' are joined again in the downstream sides of them, so that the hot blast into which the mist M is scattered is emitted from the air exit opening 132.

Figure 22A:
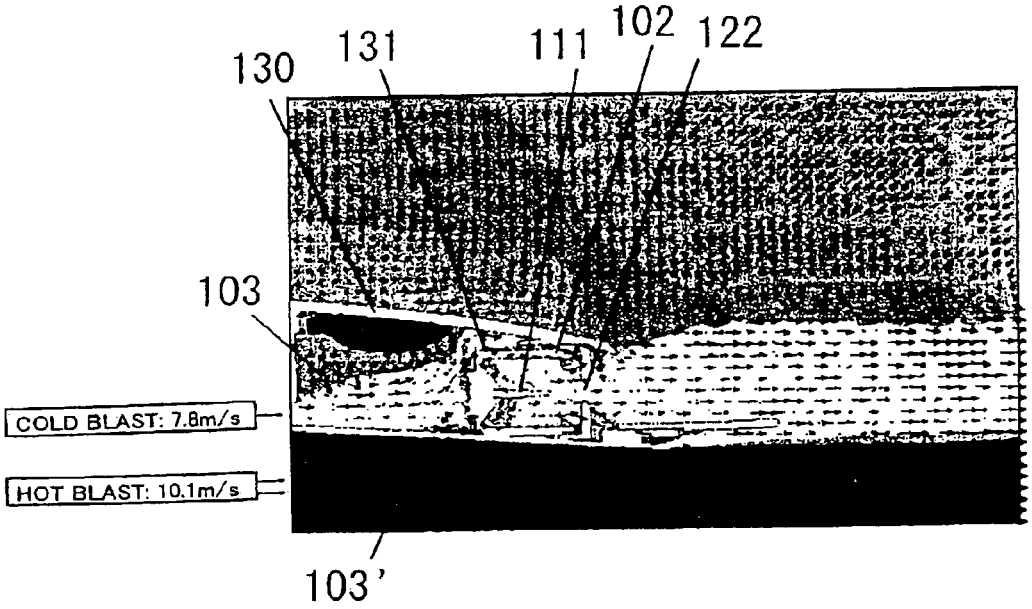
FIG. 22A is a vector diagram showing a result on analysis of airflow of a lateral face nearby a position where the electrostatic atomizer is established in the hairdryer shown in FIG. 21.
Figure 22B:
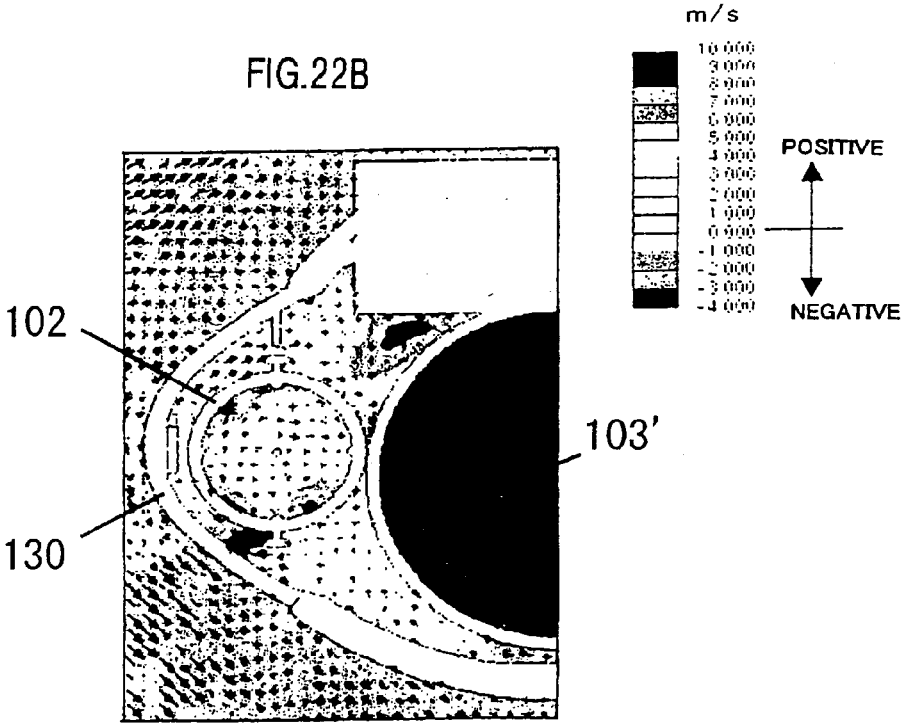
FIG. 22B is a vector diagram showing the result on analysis of airflow in the front thereof.

In this case, the airflow which is to be introduced into the inside of the housing 102 for electrostatic atomization is branched in upstream side from the heating unit 105, so that heated air is never introduced into the housing 102 for electrostatic atomization and it is possible to prevent the evaporation of the liquid L or the mist M electrostatically atomized at the front end 111*a* of the atomizing electrode 111. Consequently, it is possible to prevent the decrease of the quantity of the mist M emitted from the electrostatic atomizer 100. Result on analysis of the airflow at this time is shown in FIGS. 22A and 22B. FIG. 22A is a vector diagram showing the result on analysis of airflow of a lateral face nearby a position where the electrostatic atomizer 100 is established in the hairdryer 1 shown in FIG. 21, and FIG. 22B is a vector diagram showing the result on analysis of airflow in the front thereof. As can be seen from these figures, no reverse flow occurs in the vicinity of the front end 111*a* of the atomizing electrode 111.

This application is based on Japanese patent applications 2004-280498 and 2005-22167 in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. An electrostatic atomizing hairdryer comprising:

a main body having an air suction opening and an air exit opening;

a blower provided within the main body, wherein the blower is configured to draw air into an inside of the main body through the air suction opening so as to generate airflow in the inside of the main body, and wherein the blower is configured to emit the air, drawn into an inside of the main body, through the air exit opening;

a heater which heats at least part of the airflow generated by blower; and an electrostatic atomizer comprising:

a tank which stores a non-combustible liquid;

a mist generator which generates mist by electrostatically atomizing the non-combustible liquid;

and a mist emitting opening which emits the mist, wherein the mist emitting opening is provided in a path of the airflow generated by the blower, so that the mist emitted from the mist emitting opening is scattered into the airflow emitted from the air exit opening.

2. The electrostatic atomizing hairdryer in accordance with claim 1, wherein the mist emitting opening is provided in substantially a same plane as the air exit opening in a direction of the airflow generated by the blower;

a protector configured to prevent the introduction of extraneous material through the air exit opening, wherein the mist emitting opening is provided on the protector.

3. The electrostatic atomizing hairdryer in accordance with claim 2, wherein an antistatic treatment is applied to the protector.

4. The electrostatic atomizing hairdryer in accordance with claim 1, wherein a part of airflow generated by the blower is introduced into the electrostatic atomizer and the mist is emitted by airflow exiting the mist emitting opening.

5. The electrostatic atomizing hairdryer in accordance with claim 4, wherein the airflow is introduced into the electrostatic atomizer before being heated by the heater.

6. An electrostatic atomizer comprising:

a first housing having an airflow path provided therein;

a blower provided within the first housing to generate an airflow;

a second housing provided at a downstream side of the first housing;

an atomizing electrode provided within the second housing, the atomizing electrode having a needle or stick shape and configured to generate mist by electrostatically atomizing liquid at a front end of the atomizing electrode;

a liquid feeder which feeds liquid to the front end of the atomizing electrode;

an opposing electrode provided in the second housing and facing the front end of the atomizing electrode;

a voltage applying circuit configured to apply a voltage between the atomizing electrode and the opposing electrode;

a mist emitting opening provided in the second housing in a vicinity of the opposing electrode, wherein the mist emitting opening is configured to emit mist generated at the front end of the atomizing electrode and moved toward the opposing electrode by electrostatic force to an outside of the second housing;

wherein the atomizing electrode protrudes toward the downstream side from an inner end wall provided at an upstream side of the airflow path in the second housing, and the opposing electrode is provided farther downstream than the atomizing electrode;

introduction openings configured to introduce airflow into an inside of the second housing, wherein the introduction openings are provided on a side wall of the second housing between the inner end wall from which the atomizing electrode protrudes and the front end of the atomizing electrode in a flow direction of airflow in the airflow path;

and a tapered portion provided on the inner end wall, the tapered portion having a diameter which decreases towards the downstream side.

7. The electrostatic atomizer in accordance with claim 6, wherein a plurality of the introduction openings is provided along an outer periphery of a side wall of the second housing with an equal spacing in a direction perpendicular to the flow direction of the airflow, and wherein each introduction opening has a rectangular shape having a length of 2 to 10 mm in the flowing direction of the airflow.

8. The electrostatic atomizer in accordance with claim 6, further comprising a protector configured to prevent electric shock or electric leakage, wherein the protector is provided on a same axis of the atomizing electrode in the flow direction of the airflow in the second housing, the protector having an opening which has a diameter of 3 to 10 mm.

9. The electrostatic atomizer in accordance with claim 6, further comprising an introduction guide which introduces airflow flowing in the airflow path into the inside of the second housing, wherein the introduction guide is provided on an outer face side of the introduction openings of the second housing.

10. The electrostatic atomizer in accordance with claim 6, wherein the mist emitting opening is provided on a same axis as the atomizing electrode at an end of the second housing in the downstream side of the airflow, and a tapered guide provided inside of the second housing between the introduction openings and the mist emitting opening, wherein the diameter of the tapered guide decreases toward the downstream side of the airflow.

11. The electrostatic atomizer in accordance with claim 6, further comprising a transporter having a diameter equal to or less than 2 mm, wherein the transporter transports liquid to the atomizing electrode by capillarity.

12. The electrostatic atomizer in accordance with claim 6, further comprising a heater provided in the air flow path downstream of the blower, wherein airflow which is to be introduced into the inside of the second housing is branched to an upstream side of the heater.

13. The electrostatic atomizing hairdryer in accordance with claim 1, wherein the non-combustible liquid is water.

* * * * *